US008867228B2

(12) United States Patent
Katsura et al.

(10) Patent No.: US 8,867,228 B2
(45) Date of Patent: Oct. 21, 2014

(54) ELECTRODE BONDING STRUCTURE, AND MANUFACTURING METHOD FOR ELECTRODE BONDING STRUCTURE

(75) Inventors: Hiroaki Katsura, Fukui (JP); Koso Matsuno, Osaka (JP); Yoji Ueda, Osaka (JP)

(73) Assignee: Panasonic Corporation, Osaka (JP)

( * ) Notice: Subject to any disclaimer, the term of this patent is extended or adjusted under 35 U.S.C. 154(b) by 107 days.

(21) Appl. No.: 13/459,606

(22) Filed: Apr. 30, 2012

(65) Prior Publication Data

US 2012/0285731 A1 Nov. 15, 2012

(30) Foreign Application Priority Data

May 10, 2011 (JP) ..... 2011-105630

(51) Int. Cl.

| | |
|---|---|
| ***H01R 9/00*** | (2006.01) |
| ***H01J 11/48*** | (2012.01) |
| ***H01J 9/32*** | (2006.01) |
| ***H01J 11/10*** | (2012.01) |

(52) U.S. Cl.

CPC ..... *H01J 11/10* (2013.01); *H01J 11/48* (2013.01); *H01J 9/32* (2013.01)

USPC ..... 361/776; 361/772; 361/773; 361/774; 361/760; 361/767; 174/261; 174/254

(58) Field of Classification Search

USPC ..... 361/772, 773, 774, 776

See application file for complete search history.

(56) References Cited

U.S. PATENT DOCUMENTS 5,877,543 A * 3/1999 Matsubara et al. ..... 257/674
5,936,850 A * 8/1999 Takahashi et al. ..... 361/784

(Continued)

FOREIGN PATENT DOCUMENTS

JP 06-291439 A 10/1994
JP 2000-090840 A 3/2000

(Continued)

*Primary Examiner* — Timothy Thompson
*Assistant Examiner* — Steven T Sawyer
(74) *Attorney, Agent, or Firm* — RatnerPrestia

(57) ABSTRACT

An electrode bonding structure sealed with a sealing resin, in which a flexible substrate is bonded to a first substrate via an adhesive, wherein: a region along a bottom face edge of an flexible substrate end part is bonded, via the adhesive, to an inner side region of a region along a top face edge of an first substrate end part; a gap is formed between an inner side region of the region along the bottom face edge of the flexible substrate end part and the region along the top face edge of the first substrate end part; the sealing resin is formed so as to enter, while covering a top face of the flexible substrate end part, at least a portion of the gap; and a height of the gap gets smaller towards the adhesive from the top face edge of the first substrate end part.

4 Claims, 16 Drawing Sheets

(56) References Cited

U.S. PATENT DOCUMENTS

| | | | | |
|---|---|---|---|---|
| 5,949,512 | A * | 9/1999 | Taguchi | 349/150 |
| 6,086,441 | A * | 7/2000 | Akiguchi et al. | 445/24 |
| 6,531,662 | B1 * | 3/2003 | Nakamura | 174/255 |
| 6,806,936 | B2 | 10/2004 | Nakaminami et al. | |
| 6,909,173 | B2 | 6/2005 | Hamamoto et al. | |
| 7,036,910 | B2 | 5/2006 | Ohashi et al. | |
| 7,474,814 | B2 | 1/2009 | Nagura | |
| 7,547,094 | B2 | 6/2009 | Kawamura et al. | |
| 7,985,078 | B2 | 7/2011 | Kumazawa et al. | |
| 2005/0093128 | A1 * | 5/2005 | Mori | 257/692 |
| 2005/0196981 | A1 * | 9/2005 | Hashimoto | 439/67 |
| 2008/0123171 | A1 | 5/2008 | Dausch et al. | |
| 2010/0167597 | A1 | 7/2010 | Kumazawa et al. | |

FOREIGN PATENT DOCUMENTS

| | | | |
|---|---|---|---|
| JP | 2008-091405 | A | 4/2008 |
| JP | 2010-170086 | A | 8/2010 |
| JP | 2010-232300 | A | 10/2010 |
| JP | 2011-105630 | | 5/2014 |

* cited by examiner (B)

(A)

ELECTRODE BONDING STRUCTURE, AND MANUFACTURING METHOD FOR ELECTRODE BONDING STRUCTURE

BACKGROUND OF THE INVENTION

1. Field of the Invention

The present invention relates to an electrode bonding structure, and a manufacturing method for the electrode bonding structure, which are for use in, for example, a plasma display panel (PDP) of a display device and so on.

2. Related Art of the Invention

Conventional electrode bonding structures of various structures are known such that electrodes formed on the substrates and electrodes formed on the flexible substrates are electrically bonded using adhesive members, and the bonding portions concerned are covered with sealing resin members so as not to be exposed to the outside (see, for example, Japanese Patent Laid-Open No. 2000-90840).

Here, mainly with reference to FIG. 16, the constitution of such a conventional electrode bonding structure is described.

Further, FIG. 16 is a schematic partial enlarged sectional view of the conventional electrode bonding structure.

The conventional electrode bonding structure comprises: a rectangular back face glass substrate 10; a front face glass substrate 11 paired with the back face glass substrate 10; and a rectangular flexible substrate 12.

The back face glass substrate 10 and the front face glass substrate 11 are arranged with a fixed space held, and the peripheral part is sealed with a seal member 13.

On the surface of the back face glass substrate 10, plural back face glass substrate electrodes 14 are formed in the shape of stripes.

On the surface of the flexible substrate 12 facing the surface of the back face glass substrate 10, plural flexible substrate electrodes 12*a* are formed in positions corresponding to the back face glass substrate electrodes 14.

The back face glass substrate 10 and the flexible substrate 12 are bonded by superposing the back face glass substrate electrodes 14 and the flexible substrate electrodes 12*a* via an adhesive member 15, which is formed using anisotropic conductive sheets and so on such that conducting particles are dispersed in an insulating resin, and hardening the adhesive member 15 through heat pressurization on the flexible substrate 12 with a crimping tool.

Thus, the back face glass substrate electrodes 14 and the flexible substrate electrodes 12*a* are electrically conducted via the conducting particles in the adhesive member 15.

Moreover, the bonding part of the back face glass substrate 10 and the flexible substrate 12 is covered with two layers of resin members of an internal layer resin member 20 and an external layer resin member 21.

The internal layer resin member 20 is constituted of a resin of low water vapor permeability, and partially covers the bonding part of the back face glass substrate 10 and the flexible substrate 12.

Since the internal layer resin member 20 covers the exposed part of the electrode terminal of the back face glass substrate electrodes 14, infiltration of water contents is prevented and, even if silver (Ag) that is prone to generate migration is used in the back face glass substrate electrodes 14, a defect accompanying a short circuit is suppressed.

The external layer resin member 21 is constituted of a resin with flexibility, and is composed of an external layer resin member 21*a* covering the internal layer resin member 20, and an external layer resin member 21*b* covering the outside of a back face glass substrate edge 10*a*.

Since the external layer resin member 21 covers the bonding part of the back face glass substrate 10 and the flexible substrate 12, which are covered with the internal layer resin member 20, for the obverse and reverse, a defect accompanying detachment of the flexible substrate 12 is suppressed.

SUMMARY OF THE INVENTION

Now, in a manufacturing method for the conventional electrode bonding structure described before, the supplying and hardening of the resin for constituting the external layer resin member 21 can not be performed all at once on both sides of the faces of the flexible substrate 12.

Hence, for example, after the supplying and hardening of the resin has been performed with respect to the side of the external layer resin member 21*a* on the obverse face, the obverse and reverse of the electrode bonding structure has to be reversed to perform the supplying and hardening of the resin with respect to the side of the external layer resin member 21*b* on the reverse face.

Consequently, a manufacturing process in the manufacturing method for the electrode bonding structure has been complicated.

Further, since when the manufacturing process is thus complicated, stress is applied on the bonding part of the back face glass substrate 10 and the flexible substrate 12 at the time of reverse of the electrode bonding structure, there are many cases where a probability that a bonding defect is generated is heightened and, since the manufacturing process number is large, there are many cases where a manufacturing lead time for the electrode bonding structure is prolonged.

The present invention, in view of the conventional problems described above, provides an electrode bonding structure, and a manufacturing method for the electrode bonding structure, which are capable of more simplifying a manufacturing process.

The $1^{st}$ aspect of the present invention is an electrode bonding structure sealed with a sealing resin member, in which a flexible substrate is bonded to a first substrate via an adhesive member, wherein a region along a bottom face edge of an end part of the flexible substrate is bonded, via the adhesive member, to a region on an inner side of a region along a top face edge of an end part of the first substrate, a gap is formed between a region on an inner side of the region along the bottom face edge of the end part of the flexible substrate and the region along the top face edge of the end part of the first substrate, the sealing resin member is formed so as to enter, while covering a top face of the end part of the flexible substrate, at least a portion of the gap, and a height of the gap gets smaller towards the adhesive member from the top face edge of the end part of the first substrate.

The $2^{nd}$ aspect of the present invention is an electrode bonding structure according to the $1^{st}$ aspect of the present invention, wherein the flexible substrate is curved in a neighborhood of a border between the region along the bottom face edge of the end part of the flexible substrate and the region on the inner side of the region along the bottom face edge of the end part of the flexible substrate.

The $3^{rd}$ aspect of the present invention is an electrode bonding structure according to the $1^{st}$ aspect of the present invention, wherein the sealing resin member is formed so as to enter the portion of the gap in a vicinity of a side face of the end part of the flexible substrate, at least.

The $4^{th}$ aspect of the present invention is an electrode bonding structure according to the $1^{st}$ aspect of the present invention, wherein the flexible substrate has through holes communicated with the gap, and the sealing resin member is further formed so as to enter at least the portion of the gap through the through holes.

The $5^{th}$ aspect of the present invention is a manufacturing method for an electrode bonding structure sealed with a sealing resin member, in which a flexible substrate is bonded to a first substrate via an adhesive member, comprising:

a bonding step of bonding a region along a bottom face edge of an end part of the flexible substrate, via the adhesive member, to a region on an inner side of a region along a top face edge of an end part of the first substrate;

a gap forming step of forming a gap between a region on an inner side of the region along the bottom face edge of the end part of the flexible substrate and the region along the top face edge of the end part of the first substrate so that a height of the gap gets smaller towards the adhesive member from the top face edge of the end part of the first substrate; and a sealing resin member forming step of forming the sealing resin member so that the sealing resin member enters, while covering a top face of the end part of the flexible substrate, at least a portion of the gap.

The $6^{th}$ aspect of the present invention is a manufacturing method for an electrode bonding structure according to the $5^{th}$ aspect of the present invention, wherein the sealing resin member is formed by hardening a sealing resin with heating.

The $7^{th}$ aspect of the present invention is a manufacturing method for an electrode bonding structure according to the $5^{th}$ aspect of the present invention, wherein the sealing resin member is formed by supplying a sealing resin after the flexible substrate is curved in a neighborhood of a border between the region along the bottom face edge of the end part of the flexible substrate and the region on the inner side of the region along the bottom face edge of the end part of the flexible substrate.

The $8^{th}$ aspect of the present invention is a manufacturing method for an electrode bonding structure according to the $5^{th}$ aspect of the present invention, wherein a sealing resin member formation prearranged part, on which the sealing resin member is formed, is cleaned before a sealing resin is supplied.

By the present invention, it is possible to provide an electrode bonding structure, and a manufacturing method for the electrode bonding structure, which are capable of more simplifying a manufacturing process.

DESCRIPTION OF SYMBOLS

Figure 1:
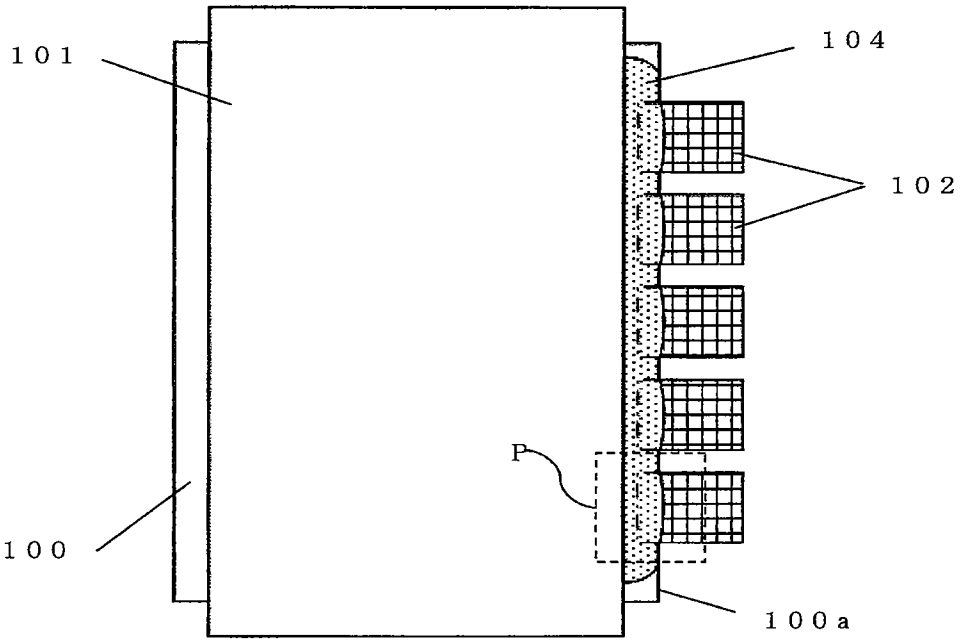
FIG. 1 is a schematic plane view of the electrode bonding structure of Embodiment 1 in the present invention.

10 back face glass substrate
10*a* back face glass substrate edge
11 front face glass substrate
12 flexible substrate
12*a* flexible substrate electrode
13 seal member
14 back face glass substrate electrode
15 adhesive member
20 internal layer resin member
21, 21*a*, 21*b* external layer resin member
100 first glass substrate
100*a* glass substrate edge
100*i*, 100*o* glass substrate region
101 second glass substrate
102 flexible substrate
102*a*, 102*b* flexible substrate side face
102*c* flexible substrate edge
102*i*, 102*o* flexible substrate region
102*u* flexible substrate top face
103 through hole
104 sealing resin member

104*a* sealing resin member part
105 adhesive member
105*a* adhesive member end part
106 seal member
107 glass substrate electrode terminal
108 sealing resin member formation prearranged part
109 glass substrate bonding prearranged part
110 glass substrate edge prearranged line
150 plasma cleaning machine
150*a* argon plasma
160 sealing resin applying machine
170 ultraviolet light irradiating machine
171 ultraviolet light
200 flexible substrate supporting holder

PREFERRED EMBODIMENTS OF THE INVENTION

Hereafter, with reference to the drawings, embodiments in the present invention are described in detail.

Embodiment 1

In the beginning, mainly with reference to FIGS. 1 to 5, the constitution of an electrode bonding structure of the present embodiment is described.

Further, FIG. 1 is a schematic plane view of the electrode bonding structure of Embodiment 1 in the present invention.

Figure 2:
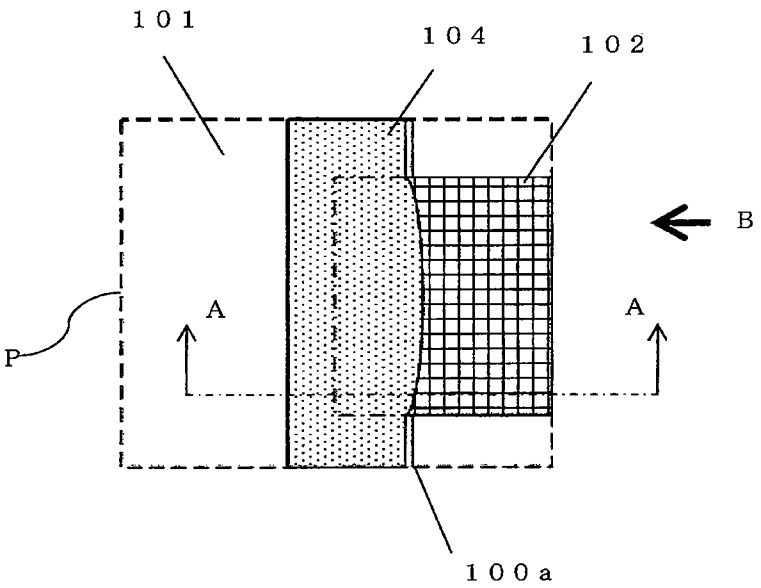
FIG. 2 is a schematic partial enlarged plane view of the electrode bonding structure of Embodiment 1 in the present invention.

Furthermore, FIG. 2 is a schematic partial enlarged plane view of the portion P (see FIG. 1) of the electrode bonding structure of Embodiment 1 in the present invention.

Figure 3:
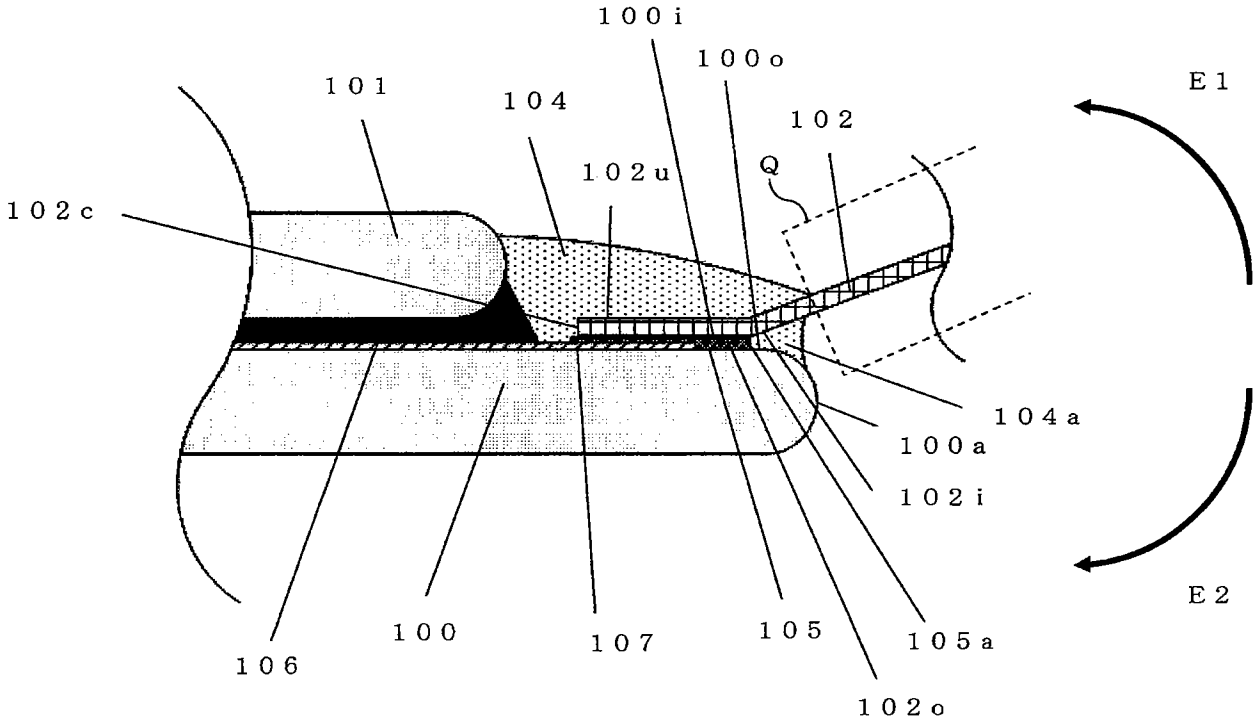
FIG. 3 is a schematic partial enlarged sectional view of the electrode bonding structure of Embodiment 1 in the present invention.

Furthermore, FIG. 3 is a schematic partial enlarged sectional view of the electrode bonding structure of Embodiment 1 in the present invention, taken along line A-A (see FIG. 2).

Figure 4:
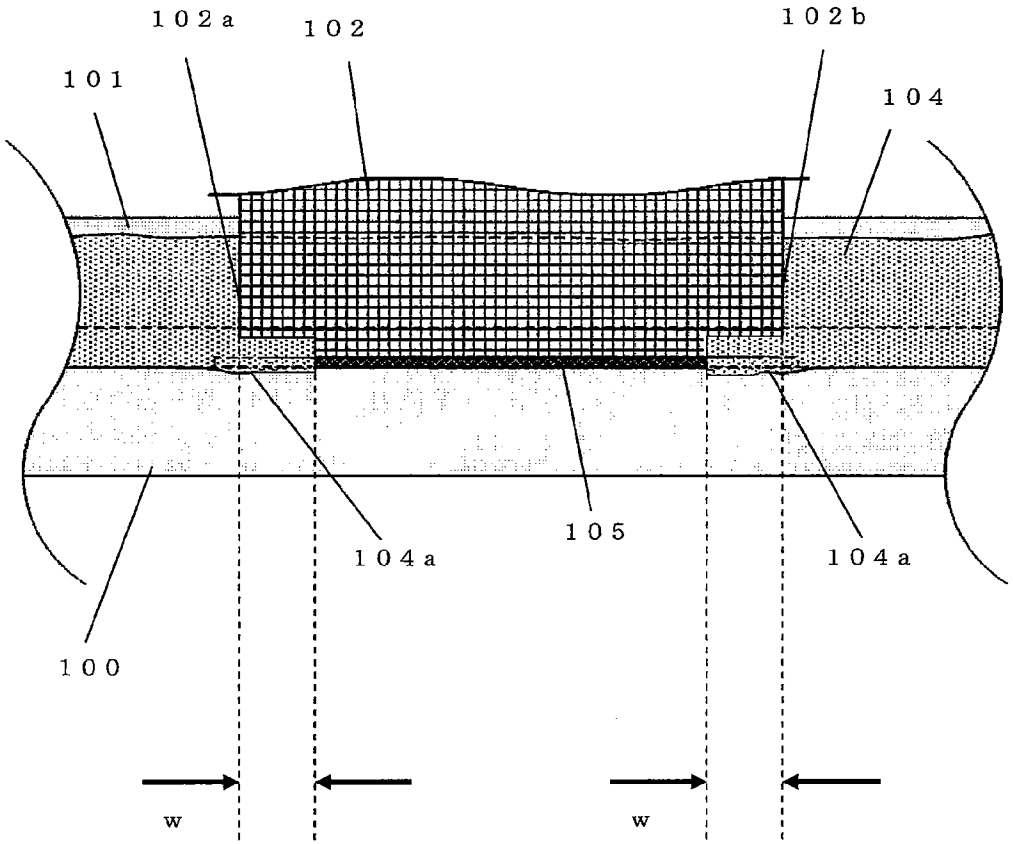
FIG. 4 is a schematic partial enlarged side view of the electrode bonding structure of Embodiment 1 in the present invention.

Furthermore, FIG. 4 is a schematic partial enlarged side view of the electrode bonding structure of Embodiment 1 in the present invention, viewed in the direction of the arrow B (see FIG. 2).

Figure 5:
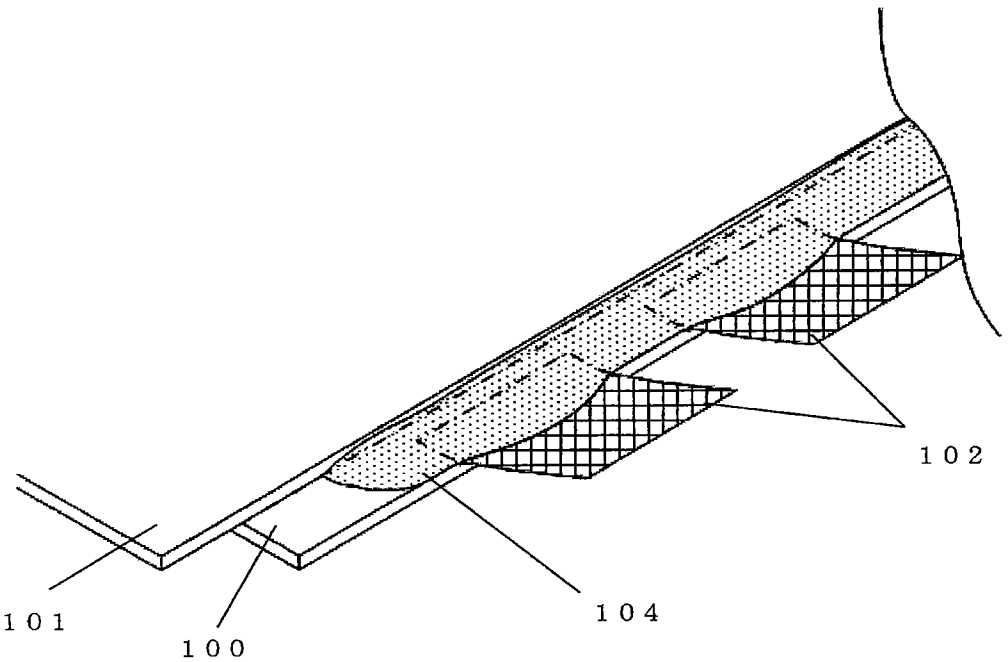
FIG. 5 is a schematic partial oblique view of the electrode bonding structure of Embodiment 1 in the present invention.

Furthermore, FIG. 5 is a schematic partial oblique view of the electrode bonding structure of Embodiment 1 in the present invention.

The electrode bonding structure of the present embodiment is an electrode bonding structure sealed with a sealing resin member 104, in which a flexible substrate 102 is bonded to a first glass substrate 100 via an adhesive member 105.

A flexible substrate region 102*o* along a flexible substrate edge 102*c* of an end part of the flexible substrate 102 is bonded, via the adhesive member 105, to a glass substrate region 100*i* on an inner side of a glass substrate region 100*o* along a glass substrate edge 100*a* of an end part of the first glass substrate 100.

A gap G (see FIG. 11) is formed between a flexible substrate region 102*i* on an inner side of the flexible substrate region 102*o* along the flexible substrate edge 102*c* of the end part of the flexible substrate 102 and the glass substrate region 100*o* along the glass substrate edge 100*a* of the end part of the first glass substrate 100.

The sealing resin member 104 is formed so as to enter, while covering a flexible substrate top face 102*u* of the end part of the flexible substrate 102, at least a portion of the gap G.

A height h (see FIG. 11) of the gap G gets smaller towards the adhesive member 105 from the glass substrate edge 100*a* of the end part of the first glass substrate 100.

Further, the flexible substrate 102 is curved in a neighborhood of a border L (see FIG. 11) between the flexible substrate region 102*o* along the flexible substrate edge 102*c* of the end part of the flexible substrate 102 and the flexible substrate region 102*i* on the inner side of the flexible substrate region 102*o* along the flexible substrate edge 102*c* of the end part of the flexible substrate 102.

Furthermore, the sealing resin member 104 is formed so as to enter the portion of the gap G in a vicinity of flexible substrate side faces 102*a* and 102*b* (see FIG. 4) of the end part of the flexible substrate 102, at least.

Hereinafter, the constitution of the electrode bonding structure of the present embodiment is more concretely described.

As shown in FIGS. 1 to 5, the electrode bonding structure of the present embodiment comprises: the rectangular first glass substrate 100; a rectangular second glass substrate 101 arranged to face the first glass substrate 100; and the plural rectangular flexible substrates 102 bonded to the first glass substrate 100.

Regarding the first glass substrate 100 and the second glass substrate 101, the peripheral part is sealed with a seal member 106 (see FIG. 3), and plural belt-shaped glass substrate electrode terminals 107 are formed on the first glass substrate 100.

The plural flexible substrates 102 are, as shown in FIG. 1, arranged along the glass substrate edge 100*a* of the first glass substrate 100 with vacancy portions being provided.

As material for the flexible substrate 102, polyimide, for example, can be used.

On the surfaces of the individual flexible substrates 102, plural belt-shaped electrodes (not shown) are formed in positions facing the glass substrate electrode terminals 107.

The first glass substrate 100 and the flexible substrates 102 are bonded by the adhesive member 105 formed using solder, anisotropic conductive films (ACF sheets) or the like.

The bonding part of the first glass substrate 100 and the flexible substrates 102 is covered and hidden with the sealing resin member 104 for purposes of damp proofing, improvement in mechanical strength and the like.

And, a sealing resin member part 104*a* is formed as a part of the sealing resin member 104.

More concretely, the sealing resin member part 104*a*, which is a part of the resin constituting the sealing resin member 104, is constituted of the resin that has entered the gap G between the first glass substrate 100 and the flexible substrates 102 from both the side faces of the flexible substrate side faces 102*a* and 102*b* (see FIG. 4).

The flexible substrates 102 are bent toward the side of the second glass substrate 101 with an adhesive member end part 105*a* on the side of the glass substrate edge 100*a* being a supporting point.

The angle □ (see FIG. 11) between the first glass substrate 100 and the flexible substrate 102 only has to be substantially larger than 0°.

More concretely, as described later, the angle □ only has to be selected as an angle such that the resin for constituting the sealing resin member part 104*a* easily enters the gap G between the first glass substrate 100 and the flexible substrates 102 in the applying step and the hardening step and, for example, may be about 5°.

Moreover, as described later, as a resin for constituting the sealing resin member 104, ultraviolet light (UV) hardening resin, silicone resin, polyurethane resin, epoxy resin and so on can be used.

Next, mainly with reference to FIGS. 6 to 12, a manufacturing method for the electrode bonding structure of the present embodiment is described.

Figure 6:
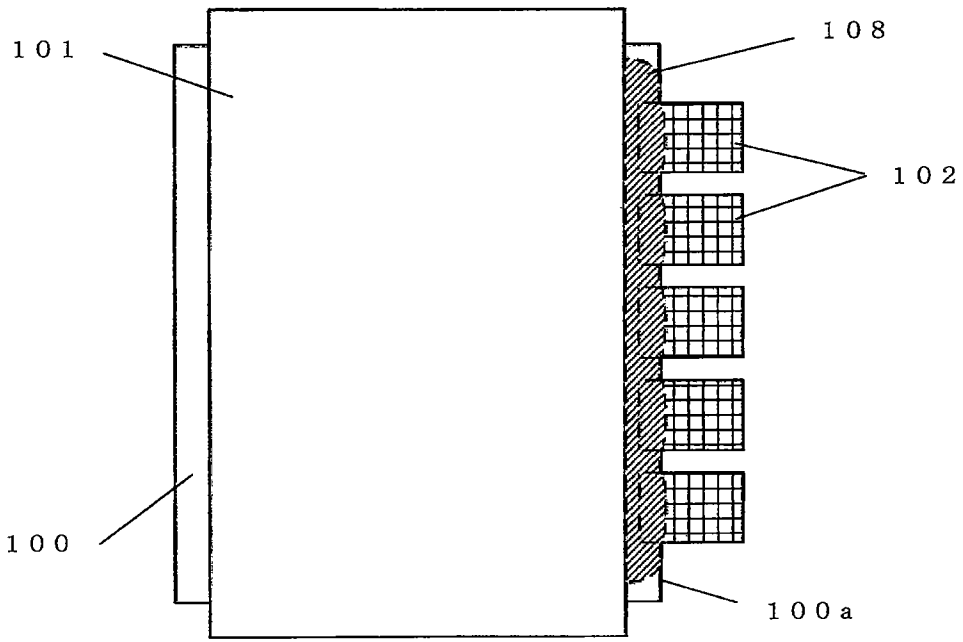
FIG. 6 is a schematic plane view describing a state of the electrode bonding structure of Embodiment 1 in the present invention before forming the sealing resin member.

Further, FIG. 6 is a schematic plane view describing a state of the electrode bonding structure of Embodiment 1 in the present invention before forming the sealing resin member 104.

Figure 7:
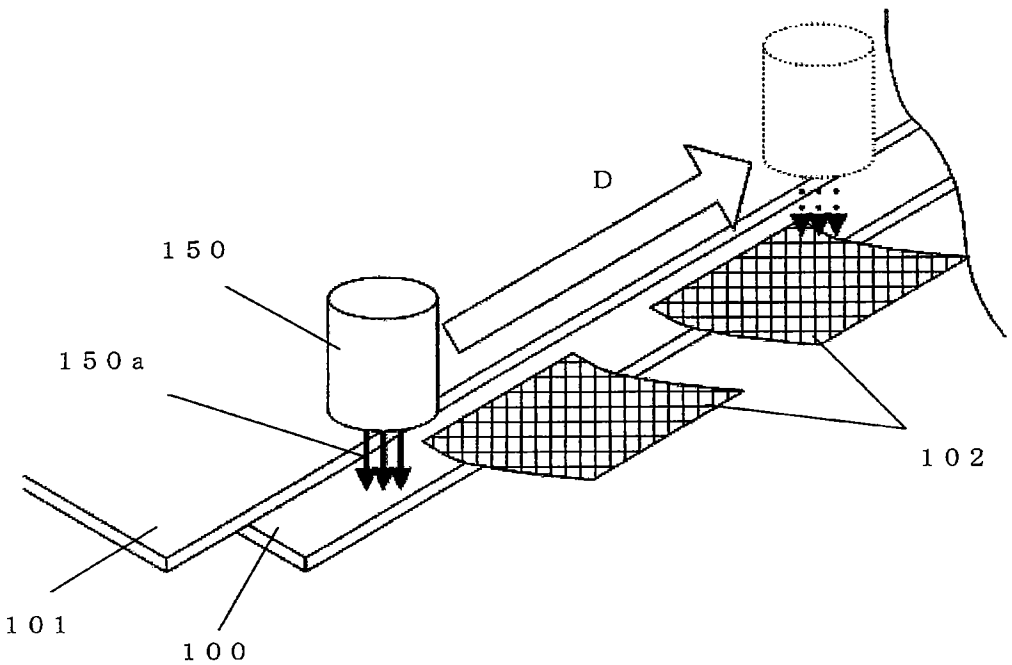
FIG. 7 is a schematic partial oblique view describing the cleaning step of performing plasma cleaning of the manufacturing method for the electrode bonding structure of Embodiment 1 in the present invention.

Furthermore, FIG. 7 is a schematic partial oblique view describing the cleaning step of performing plasma cleaning of the manufacturing method for the electrode bonding structure of Embodiment 1 in the present invention.

Figure 8:
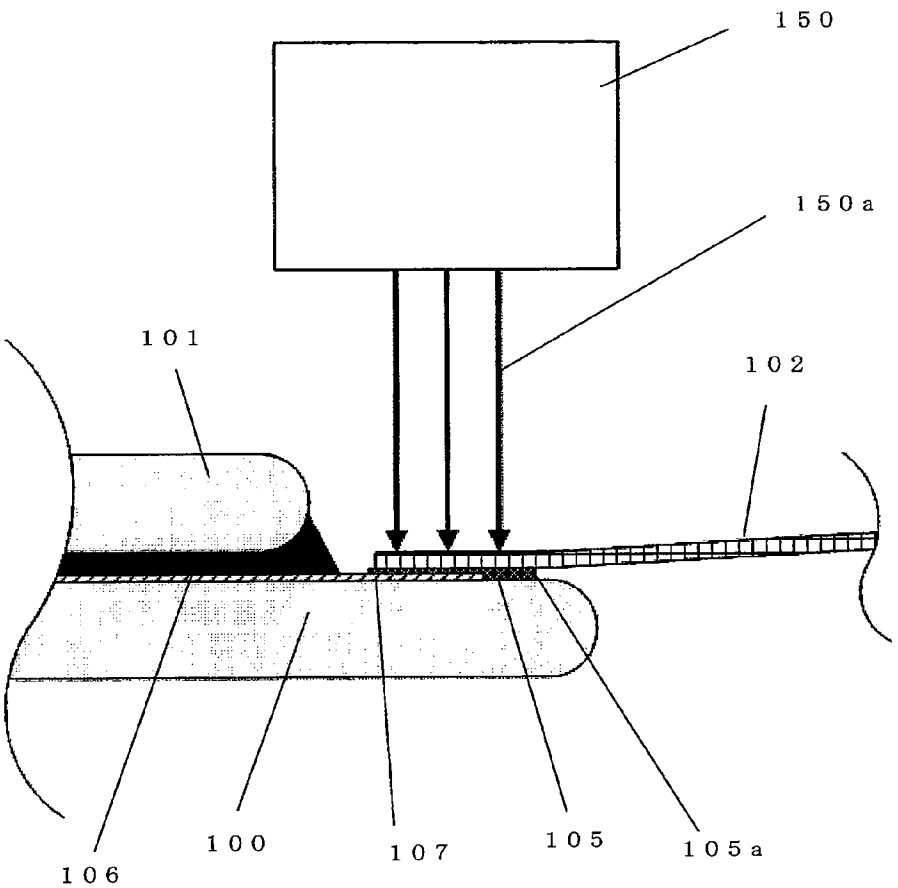
FIG. 8 is a schematic partial enlarged sectional view describing the cleaning step of performing plasma cleaning of the manufacturing method for the electrode bonding structure of Embodiment 1 in the present invention.
Figure 9:
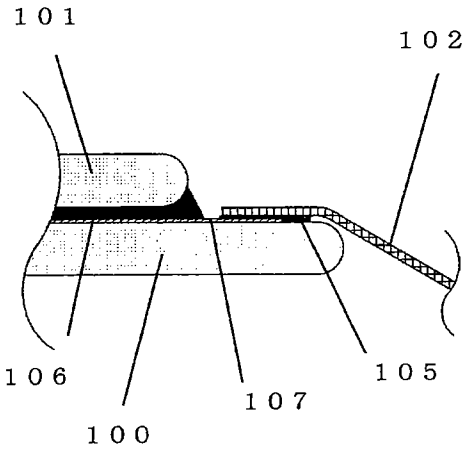
FIG. 9(A) is a schematic partial enlarged sectional view (No. 1) describing a state of the first glass substrate, the second glass substrate, and the flexible substrate of the electrode bonding structure of Embodiment 1 in the present invention before forming the sealing resin member.
FIG. 9(B) is a schematic partial enlarged sectional view (No. 2) describing a state of the first glass substrate, the second glass substrate, and the flexible substrate of the electrode bonding structure of Embodiment 1 in the present invention before forming the sealing resin member.
Figure 9:
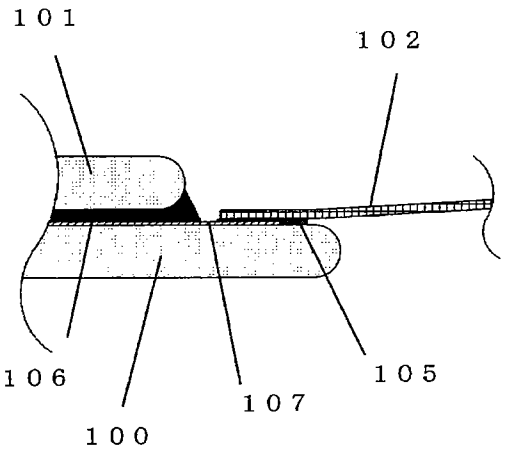

Furthermore, FIG. 8 is a schematic partial enlarged sectional view describing the cleaning step of performing plasma cleaning of the manufacturing method for the electrode bonding structure of Embodiment 1 in the present invention.

Furthermore, FIG. 9(A) is a schematic partial enlarged sectional view (No. 1) describing a state of the first glass substrate 100, the second glass substrate 101, and the flexible substrate 102 of the electrode bonding structure of Embodiment 1 in the present invention before forming the sealing resin member 104, and FIG. 9(B) is a schematic partial enlarged sectional view (No. 2) describing a state of the first glass substrate 100, the second glass substrate 101, and the flexible substrate 102 of the electrode bonding structure of Embodiment 1 in the present invention before forming the sealing resin member 104.

Figure 10:
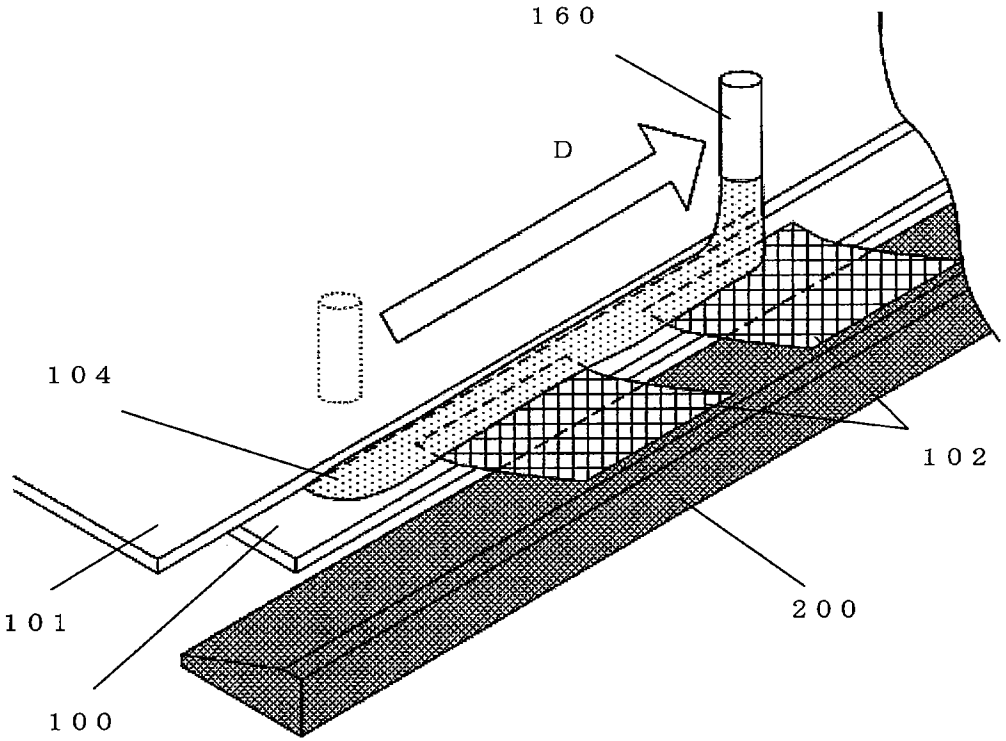
FIG. 10 is a schematic partial oblique view describing the applying step of applying, while supporting the flexible substrates, the resin for constituting the sealing resin member of the manufacturing method for the electrode bonding structure of Embodiment 1 in the present invention.

Furthermore, FIG. 10 is a schematic partial oblique view describing the applying step of applying, while supporting the flexible substrates 102, the resin for constituting the sealing resin member 104 of the manufacturing method for the electrode bonding structure of Embodiment 1 in the present invention.

Figure 11:
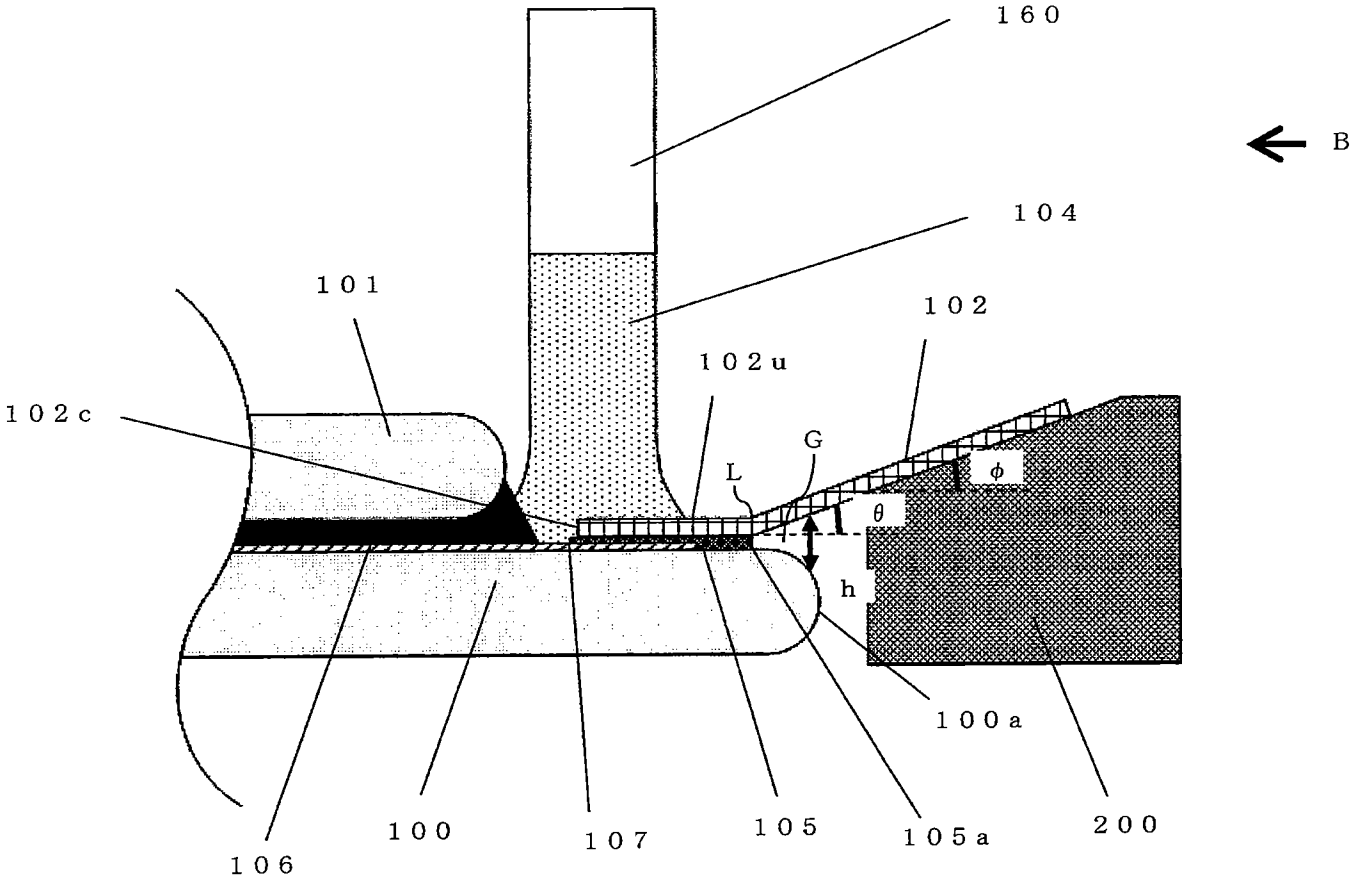
FIG. 11 is a schematic partial enlarged sectional view describing the applying step of applying, while supporting the flexible substrate, the resin for constituting the sealing resin member of the manufacturing method for the electrode bonding structure of Embodiment 1 in the present invention.

Furthermore, FIG. 11 is a schematic partial enlarged sectional view describing the applying step of applying, while supporting the flexible substrate 102, the resin for constituting the sealing resin member 104 of the manufacturing method for the electrode bonding structure of Embodiment 1 in the present invention.

Figure 12:
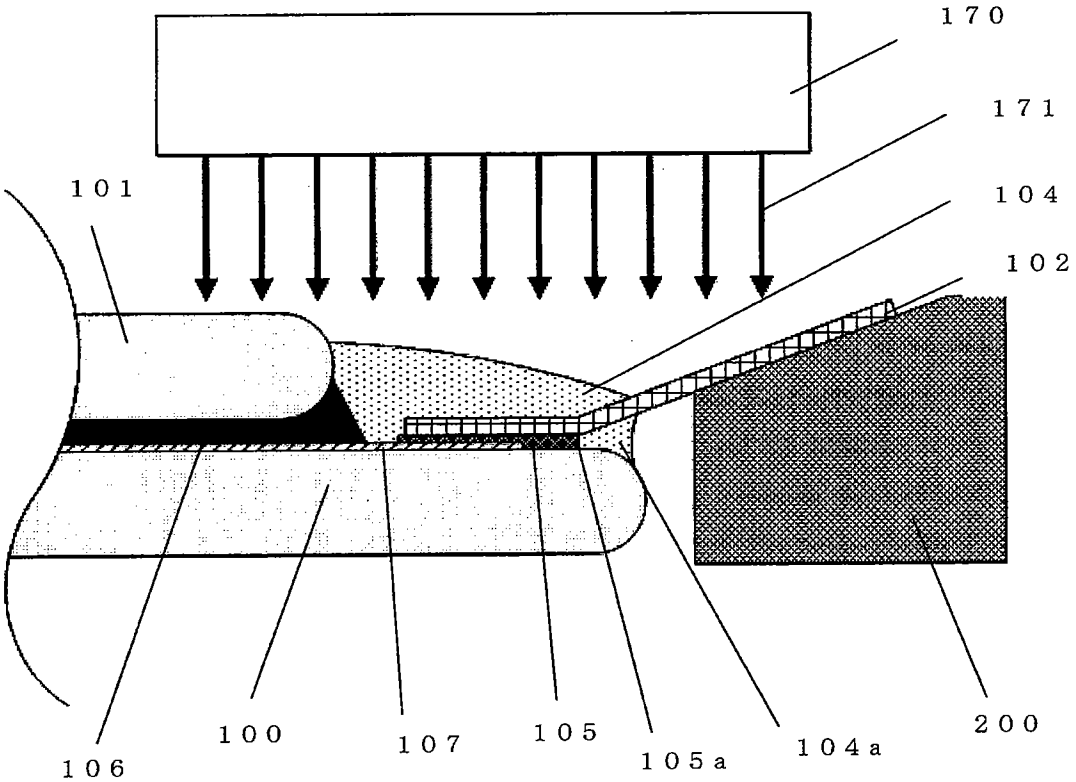
FIG. 12 is a schematic partial enlarged sectional view describing the hardening step of hardening, while supporting the flexible substrate, the applied resin for constituting the sealing resin member of the manufacturing method for the electrode bonding structure of Embodiment 1 in the present invention.

Furthermore, FIG. 12 is a schematic partial enlarged sectional view describing the hardening step of hardening, while supporting the flexible substrate 102, the applied resin for constituting the sealing resin member 104 of the manufacturing method for the electrode bonding structure of Embodiment 1 in the present invention.

The manufacturing method for the electrode bonding structure of the present embodiment is a manufacturing method for the electrode bonding structure sealed with the sealing resin member 104, in which the flexible substrate 102 is bonded to the first glass substrate 100 via the adhesive member 105, and comprises: a bonding step; a gap forming step; and a sealing resin member forming step.

The bonding step bonds the flexible substrate region 102*o* along the flexible substrate edge 102*c* of the end part of the flexible substrate 102, via the adhesive member 105, to the glass substrate region 100*i* on an inner side of the glass substrate region 100*o* along the glass substrate edge 100*a* of the end part of the first glass substrate 100.

The gap forming step forms the gap G between the flexible substrate region 102*i* on an inner side of the flexible substrate region 102*o* along the flexible substrate edge 102*c* of the end part of the flexible substrate 102 and the glass substrate region 100*o* along the glass substrate edge 100*a* of the end part of the first glass substrate 100 so that the height h of the gap G gets smaller towards the adhesive member 105 from the glass substrate edge 100*a* of the end part of the first glass substrate 100.

The sealing resin member forming step forms the sealing resin member 104 so that the sealing resin member 104 enters, while covering the flexible substrate top face 102*u* of the end part of the flexible substrate 102, at least a portion of the gap G.

Further, in the manufacturing method for the electrode bonding structure of the present embodiment, the sealing resin member 104 is formed by hardening a sealing resin with heating.

Furthermore, in the manufacturing method for the electrode bonding structure of the present embodiment, the sealing resin member 104 is formed by supplying a sealing resin after the flexible substrate 102 is curved in a neighborhood of the border L between the flexible substrate region 102*o* along the flexible substrate edge 102*c* of the end part of the flexible substrate 102 and the flexible substrate region 102*i* on the inner side of the flexible substrate region 102*o* along the flexible substrate edge 102*c* of the end part of the flexible substrate 102.

Furthermore, in the manufacturing method for the electrode bonding structure of the present embodiment, a sealing resin member formation prearranged part 108, on which the sealing resin member 104 is formed, is cleaned before a sealing resin is supplied.

Hereinafter, the manufacturing method for the electrode bonding structure of the present embodiment is more concretely described.

The steps in the manufacturing method for the electrode bonding structure of the present embodiment other than the steps of forming the sealing resin member 104 are similar to such steps in a conventional manufacturing method for the electrode bonding structure.

So, description is given hereafter from the state before forming the sealing resin member 104 using an acrylic ultraviolet light hardening resin.

Of course, the state before forming the sealing resin member 104 means a state where the first glass substrate 100 and the second glass substrate 101 are allowed to adhere to each other by sealing the peripheral part with the seal member 106, and the first glass substrate 100 and the second glass substrate 101 are bonded by the adhesive member 105.

First, as shown in FIGS. 7 and 8, cleaning of the sealing resin member formation prearranged part 108 (see FIG. 6) similar to the sealing resin member 104 in shape is performed by moving a plasma cleaning machine 150, while irradiating argon plasma 150*a* from the plasma cleaning machine 150 in a spotlike manner, along the direction of the bold arrow D relatively to the first glass substrate 100 in parallel with the glass substrate edge 100*a*.

Thus, wettability of the sealing resin member formation prearranged part 108 is improved.

Further, oxygen may be added to the argon plasma 150*a* for purposes of improving cleaning capability.

Furthermore, in case the irradiation spot diameter of the argon plasma 150*a* is smaller than the width of the sealing resin member formation prearranged part 108, the cleaning of the sealing resin member formation prearranged part 108 (1) may be performed by moving plural plasma cleaning machines 150 installed with their irradiation positions being shifted, or (2) may be performed by moving one plasma cleaning machine 150 while shifting its cleaning position.

Furthermore, the cleaning of the sealing resin member formation prearranged part 108 may be performed by ultraviolet light irradiation.

Furthermore, the cleaning of the sealing resin member formation prearranged part 108 may be performed while, as in the applying step, the hardening step and the like described later, the bottom face of the flexible substrate 102 is supported with a flexible substrate supporting holder 200 (see FIG. 10).

Meanwhile, the state of the flexible substrate 102 before forming the sealing resin member 104 is either a state of being warped up (see FIG. 9(A)) toward the side of the second glass substrate 101, or a state of hanging down (see FIG. 9(B)) toward the side of the first glass substrate 100.

This is due to the influence of a load generated between the first glass substrate 100 and the flexible substrate 102 in the bonding step using the adhesive member 105, a load generated at the time of conveyance after the said bonding step, self-weight of the flexible substrate 102, and so on.

As shown in FIG. 10, the flexible substrate 102 is, in the applying step of the resin for constituting the sealing resin member 104, lifted by the flexible substrate supporting holder 200.

And, every flexible substrate 102 is held so that the angle □ between the first glass substrate 100 and the flexible substrate 102 will be a fixed angle of about 5°, for example.

The flexible substrate supporting holder 200 is installed so as to lie on the outer side of the glass substrate edge 100*a*.

Since the flexible substrate 102 in line contact with the flexible substrate supporting holder 200 only has to be lifted from below, the sectional angle □ of the flexible substrate supporting holder 200 that is equal to or less than the angle □ described before between the first glass substrate 100 and the flexible substrate 102 is, in many cases, sufficient.

And, as shown in FIG. 11, the application of the resin for constituting the sealing resin member 104 is performed by moving a sealing resin applying machine 160, while discharging the said resin with the flexible substrate 102 being held at the fixed angle, along the direction of the bold arrow D relatively to the first glass substrate 100 in parallel with the glass substrate edge 100*a*.

Further, the cleaning step and the applying step may be performed so as to be completed substantially at the same time by adopting a device configuration such that the plasma cleaning machine 150 and the sealing resin applying machine 160 are unified, and applying, while cleaning the sealing resin member formation prearranged part 108, the resin for constituting the sealing resin member 104 in a parallel manner. Manufacturing lead time can be shortened through the cleaning step and the applying step that are performed so as to be completed substantially at the same time.

Next, as shown in FIG. 12, the hardening of the applied resin for constituting the sealing resin member 104 is performed by irradiating, for a fixed period of time, ultraviolet light 171 with a wavelength of about 354 nm, for example, under a heated atmosphere with an ultraviolet light irradiating machine 170.

The period of time for which the ultraviolet light 171 is irradiated only has to be a period of time that can ensure the light quantity necessary for hardening the resin used for constituting the sealing resin member 104 and, for example, may be about 30 seconds.

In case a high pressure mercury lamp, a metal halide lamp or the like is used as a light source of the ultraviolet light irradiating machine 170, a heating apparatus is not necessary in particular since heat is generated from the said light source, but a heating apparatus such as a heater and so on may be installed according to the need.

Now, the resin for constituting the sealing resin member 104 begins to spread right after the application in the direction toward the glass substrate edge 100*a*.

However, under an atmosphere of about 20 to 30° C. such as a general clean environment and so on in the applying step, the temperature of the resin for constituting the sealing resin member 104 is low, and the resin with high viscosity does not have sufficient fluidity and does not spread further so much.

Under the heated atmosphere of about 50° C. or more in the later hardening step, the temperature of the resin for constituting the sealing resin member 104 rises, and the resin with lower viscosity has sufficient fluidity and spreads further.

Namely, the resin for constituting the sealing resin member 104, while hardening, spreads further in the direction toward the glass substrate edge 100*a*.

And, in the neighborhood of the flexible substrate side faces 102*a* and 102*b*, a part of the resin for constituting the sealing resin member 104, while spreading in the direction toward the glass substrate edge 100*a*, enters the gap G formed by the flexible substrate supporting holder 200 between the flexible substrates 102 and the first glass substrate 100.

The height h of the gap G between the flexible substrate 102 and the first glass substrate 100 gets smaller along the direction of the arrow B towards the adhesive member end part 105*a*, and is smallest at the adhesive member end part 105*a*.

Because of this, the part of the resin for constituting the sealing resin member 104 enters the gap G from this place the space of which is smallest, and gradually spreads further toward a place the space of which is large.

This is due to the influence of a capillary phenomenon and so on.

The resin that has entered the gap G between the flexible substrate 102 and the first glass substrate 100, when being irradiated with the ultraviolet light 171, hardens similarly to the resin of other places.

Thus, the resin for constituting the sealing resin member part 104*a* enters the underside of the flexible substrate 102 with such an extent of resin quantity that the fringe part of the sealing resin member 104 is not extended outward so much compared to the glass substrate edge 100*a*, and hardens, so that the sealing resin member part 104*a* is formed.

There are almost no air bubbles and so on mixed into the resin like this constituting the sealing resin member part 104*a*, which has entered the gap G between the flexible substrate 102 and the first glass substrate 100.

In the manufacturing method for the electrode bonding structure of the present embodiment, since it is enough to perform the supplying and hardening of the resin for constituting the sealing resin member 104 only once on a single side of the face of the flexible substrate 102, reversing the obverse and reverse of the electrode bonding structure as in the manufacturing method for the conventional electrode bonding structure described before is not necessary, and the manufacturing process is more simplified.

Accordingly, since there is no fear of stress applied on the bonding part of the first glass substrate 100 and the flexible substrate 102 at the time of reverse of the electrode bonding structure, a probability that a bonding defect is generated is fairly lowered and, since the manufacturing process number gets small, a manufacturing lead time for the electrode bonding structure is greatly shortened.

Further, the formation of the sealing resin member 104 may be performed, for example, by a printing process using a mask for printing provided with through holes similar to the sealing resin member formation prearranged part 108 in shape.

In case the electrode bonding structure is for use in, for example, a plasma display panel of a display device and so on, since a space saving and a large screen are to be required for a plasma display panel, the flexible substrate 102 is bent in the assembling step after manufacture of the electrode bonding structure by a worker in the direction of the arrow E1 or E2, for example, in order to make the area of the portions that are not involved in the display of the images in planar view smaller to perform compactification of the electrode bonding structure.

In the electrode bonding structure of the present embodiment, even if external force against the flexible substrate 102 is applied at the time of a bend of the flexible substrate 102 in such an assembling step, stress applied on the bonding part of the first glass substrate 100 and the flexible substrate 102 is efficiently mitigated.

This is because a part of the resin for constituting the sealing resin member 104 has entered the gap G between the first glass substrate 100 and the flexible substrates 102 from both the side faces of the flexible substrate side faces 102*a* and 102*b*.

When the width w (see FIG. 4) of the sealing resin member part 104*a* is about 0.25 mm or more, even if external force against the flexible substrate 102 is applied at the time of a bend of the flexible substrate 102, stress applied on the bonding part of the first glass substrate 100 and the flexible substrate 102 is efficiently mitigated, and a defect accompanying detachment of a flexible substrate can be sufficiently suppressed.

Further, in the conventional electrode bonding structure described before, since a portion of the flexible substrate 12, which is covered with the external layer resin member 21*b*, is difficult to bend, there are many cases where a bend of the flexible substrate 12 can only be performed so that the portion R on the outer side of the neighborhood of the fringe part of the external layer resin member 21*b*, which is extended outward so much compared to the back face glass substrate edge 10*a*, is bent in the direction of the arrow F1 or F2, and sufficient compactification of the electrode bonding structure can not be performed.

In the manufacturing method for the electrode bonding structure of the present embodiment, a bend of the flexible substrate 102 can be performed so that the portion Q (see FIG. 3) on the outer side of the neighborhood of the fringe part of the sealing resin member 104, which almost coincides with the glass substrate edge 100*a*, is bent in the direction of the arrow E1 or E2, and sufficient compactification of the electrode bonding structure can be performed.

Furthermore, in the manufacturing method for the conventional electrode bonding structure described before, the application of the resin using a dispenser is performed by a method of carrying out the application on each of the plural flexible substrates 12 arranged with vacancy portions being provided, a method of carrying out the application along the back face glass substrate edge 10*a*, and so on.

However, in the former method, since the starting spots and the ending spots with generally high probability that the application becomes unstable have to be provided on each of the plural flexible substrates 12, there are many cases where a shape defect of the external layer resin member 21*b* is generated and, in the latter method, since the resin drips down at vacancy portions between the flexible substrates 12 that are adjacent, there are many cases where much resin disposed of is wasted.

In the manufacturing method for the electrode bonding structure of the present embodiment, it is enough to perform the application of the resin for constituting the sealing resin member 104, for example, by moving the sealing resin applying machine 160, while discharging the said resin with the flexible substrate 102 being held at a fixed angle, relatively to the first glass substrate 100 in parallel with the glass substrate edge 100*a*.

Accordingly, since a part of the resin for constituting the sealing resin member 104 proceeds to enter the gap G between the first glass substrate 100 and the flexible substrates 102, a shape defect of the sealing resin member 104 is not likely to be generated, and little resin is wasted.

Embodiment 2

Figure 13:
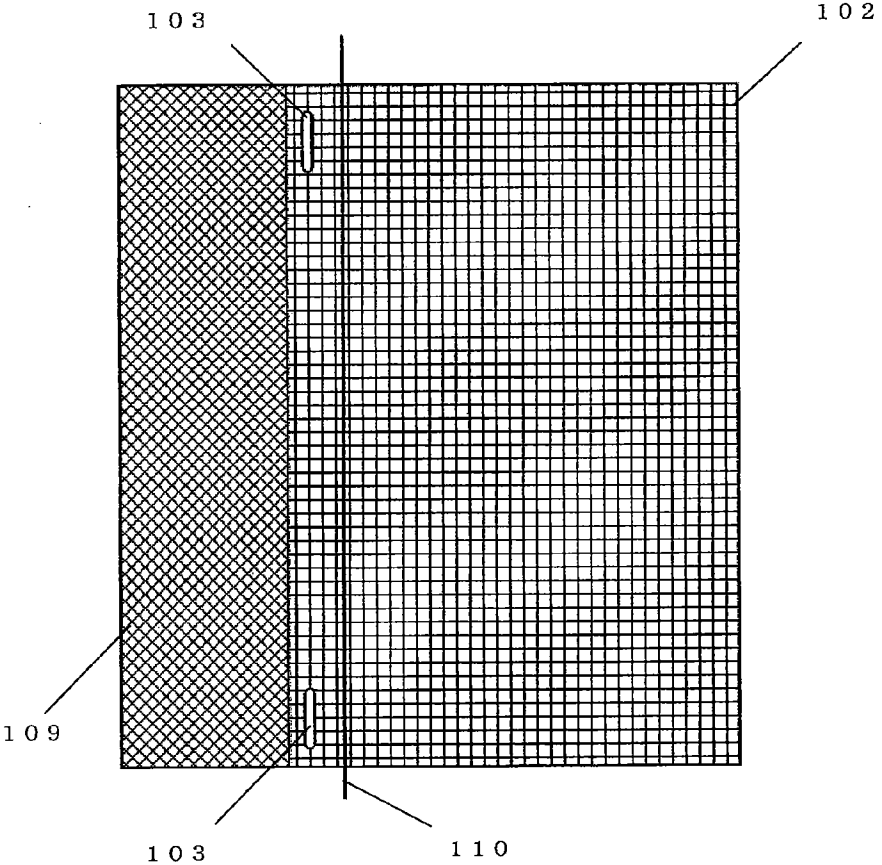
FIG. 13 is a schematic plane view of the flexible substrate of the electrode bonding structure of Embodiment 2 in the present invention.
Figure 14:
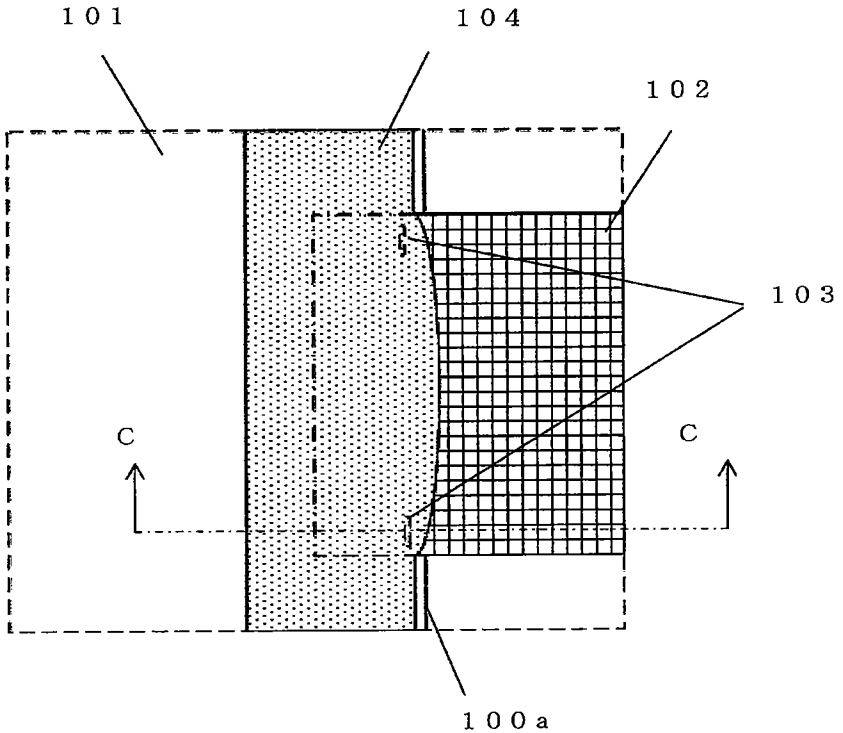
FIG. 14 is a schematic partial enlarged plane view of the electrode bonding structure of Embodiment 2 in the present invention.
Figure 15:
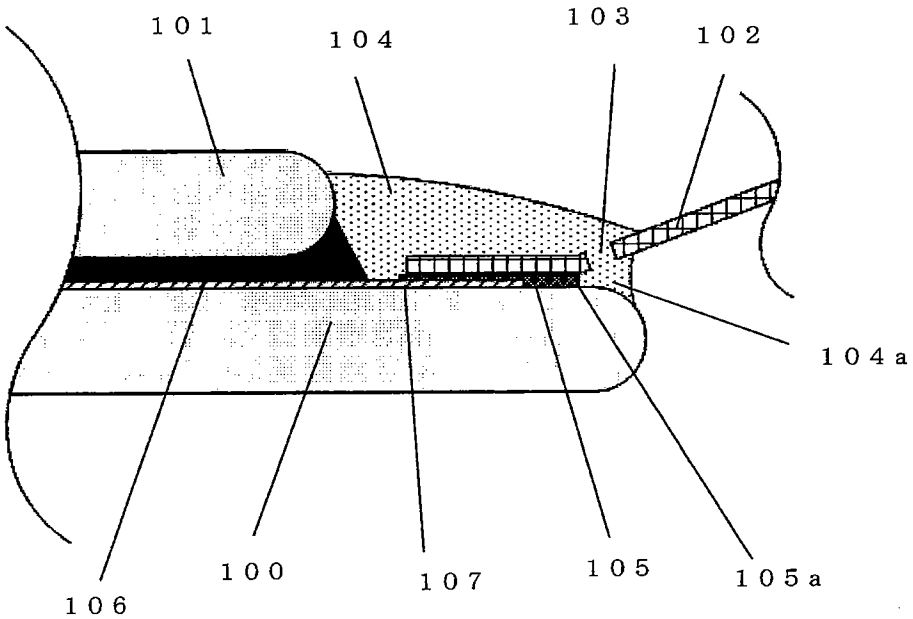
FIG. 15 is a schematic partial enlarged sectional view of the electrode bonding structure of Embodiment 2 in the present invention.
Figure 16:
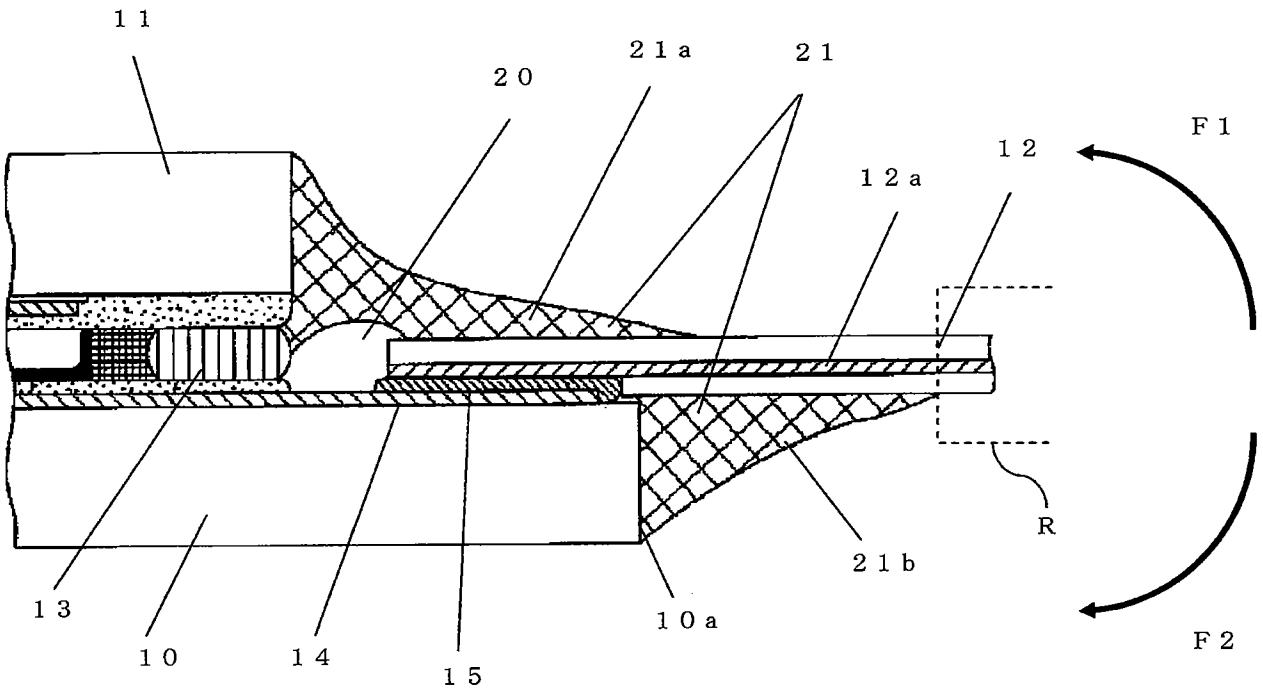
FIG.16 PRIOR ART
FIG. 16 is a schematic partial enlarged sectional view of the conventional electrode bonding structure.

Next, mainly with reference to FIGS. 13 to 15, an electrode bonding structure of the present embodiment, and a manufacturing method for the said electrode bonding structure are described.

Further, FIG. 13 is a schematic plane view of the flexible substrate 102 of the electrode bonding structure of Embodiment 2 in the present invention.

Furthermore, FIG. 14 is a schematic partial enlarged plane view of the electrode bonding structure of Embodiment 2 in the present invention.

Furthermore, FIG. 15 is a schematic partial enlarged sectional view of the electrode bonding structure of Embodiment 2 in the present invention, taken along line C-C (see FIG. 14).

The electrode bonding structure of the present embodiment, and the manufacturing method for the said electrode bonding structure are analogous to those of Embodiment 1 described before, and accomplish similar effects.

But, the electrode bonding structure of the present embodiment, and the manufacturing method for the electrode bonding structure are different from those of Embodiment 1 described before mainly in the following points.

The flexible substrate 102 has through holes 103 communicated with the gap G (see FIG. 11).

The sealing resin member 104 is further formed so as to enter at least the portion of the gap G through the through holes 103.

Hereinafter, the manufacturing method for the electrode bonding structure of the present embodiment is more concretely described.

In the present embodiment, the through holes 103 are provided in the flexible substrate 102.

As shown in FIG. 13, openings of the through holes 103 are provided so as to lie between a glass substrate bonding prearranged part 109, which is prearranged so that the first glass substrate 100 will be bonded together, and a glass substrate edge prearranged line 110, which is prearranged to overlap the glass substrate edge 100*a* when viewed in the direction perpendicular to the face of the first glass substrate 100.

The number of the through holes 103 only has to be at least one.

As shown in FIG. 15, a part of the resin for constituting the sealing resin member 104 enters, also through the through holes 103, the gap G (see FIG. 11) formed by the flexible substrate supporting holder 200 between the flexible substrates 102 and the first glass substrate 100.

And, similarly to the case of Embodiment 1 described before, the resin for constituting the sealing resin member part 104*a* enters the underside of the flexible substrate 102 and hardens, so that the sealing resin member part 104*a* is formed.

In the present embodiment, the part of the resin for constituting the sealing resin member 104 proceeds to enter the gap G between the first glass substrate 100 and the flexible substrates 102 not only from both the side faces of the flexible substrate side faces 102*a* and 102*b*, but also through the through holes 103.

Hence, the formation of the sealing resin member part 104*a* is performed more stably.

The electrode bonding structure, and the manufacturing method for the electrode bonding structure in the present invention are capable of more simplifying a manufacturing process, and are valuable for use in, for example, a plasma display panel of a display device and so on.

What is claimed is:

1. An electrode bonding structure sealed with a sealing resin member, in which a flexible substrate is bonded to a first substrate via an adhesive member, wherein a region along a bottom face edge of an end part of the flexible substrate is bonded, via the adhesive member, to a region on an inner side of a region along a top face edge of an end part of the first substrate, so that the region along the bottom face edge of the end part of the flexible substrate is parallel with a top face of the end part of the first substrate, the flexible substrate is curved in a neighborhood of a border between the region along the bottom face edge of the end part of the flexible substrate and a region on an inner side of the region along the bottom face edge of the end part of the flexible substrate, with an end part of the adhesive member, which is on a side of the top face edge of the end part of the first substrate, being a supporting point, a gap is formed between the region on the inner side of the region along the bottom face edge of the end part of the flexible substrate and the region along the top face edge of the end part of the first substrate, the sealing resin member is formed so as to enter, while covering a top face of the end part of the flexible substrate, only both side portions of the gap within a predetermined distance from a side face of the end part of the flexible substrate, and a height of the gap gets smaller towards the adhesive member from the top face edge of the end part of the first substrate.

2. A manufacturing method for an electrode bonding structure sealed with a sealing resin member, in which a flexible substrate is bonded to a first substrate via an adhesive member, comprising:

a bonding step of bonding a region along a bottom face edge of an end part of the flexible substrate, via the adhesive member, to a region on an inner side of a region along a top face edge of an end part of the first substrate, so that the region along the bottom face edge of the end part of the flexible substrate is parallel with a top face of the end part of the first substrate, the flexible substrate is curved in a neighborhood of a border between the region along the bottom face edge of the end part of the flexible substrate and a region on an inner side of the region along the bottom face edge of the end part of the flexible substrate, with an end part of the adhesive member, which is on a side of the to face edge of the end part of the first substrate, being a supporting point;

a gap forming step of forming a gap between the region on the inner side of the region along the bottom face edge of the end part of the flexible substrate and the region along the top face edge of the end part of the first substrate so that a height of the gap gets smaller towards the adhesive member from the top face edge of the end part of the first substrate; and a sealing resin member forming step of forming the sealing resin member so that the sealing resin member enters, while covering a top face of the end part of the flexible substrate, only both side portions of the gap within a predetermined distance from a side face of the end part of the flexible substrate.

3. A manufacturing method for an electrode bonding structure according to claim 2, wherein the sealing resin member is formed by hardening a sealing resin with heating.

4. A manufacturing method for an electrode bonding structure according to claim 2, wherein a sealing resin member formation prearranged part, on which the sealing resin member is formed, is cleaned before a sealing resin is supplied.

* * * * *